US007007680B2

(12) United States Patent
Tussing et al.

(10) Patent No.: US 7,007,680 B2
(45) Date of Patent: Mar. 7, 2006

(54) COOLER BYPASS VALVE SYSTEM AND METHOD

(75) Inventors: Brian Lee Tussing, Hagerstown, MD (US); David Oliver Britner, Hagerstown, MD (US); Stephen Mark Geyer, State Line, PA (US)

(73) Assignee: Mack Trucks, Inc., Allentown, PA (US)

( * ) Notice: Subject to any disclaimer, the term of this patent is extended or adjusted under 35 U.S.C. 154(b) by 12 days.

(21) Appl. No.: 10/635,500

(22) Filed: Aug. 7, 2003

(65) Prior Publication Data

US 2005/0028796 A1 Feb. 10, 2005

(51) Int. Cl.
*F02M 25/07* (2006.01)
*F02B 33/34* (2006.01)

(52) U.S. Cl. ..... 123/568.12; 123/563

(58) Field of Classification Search ..... 123/568.11, 123/568.12, 563; 60/599, 605.2; 701/108
See application file for complete search history.

(56) References Cited

U.S. PATENT DOCUMENTS

| | | | | |
|---|---|---|---|---|
| 2,581,334 | A | 1/1952 | Reggio | |
| 3,894,392 | A | 7/1975 | Melchior | |
| 4,186,560 | A | 2/1980 | Frankl | |
| 4,207,848 | A | 6/1980 | Dinger et al. | |
| 4,385,496 | A | 5/1983 | Yamane | |
| 5,385,019 | A | 1/1995 | Kulig et al. | |
| 5,617,726 | A * | 4/1997 | Sheridan et al. | 60/605.2 |
| 6,273,076 | B1 | 8/2001 | Beck et al. | |
| 6,336,447 | B1 | 1/2002 | Bartel et al. | |
| 6,367,256 | B1 * | 4/2002 | McKee | 60/605.2 |
| 6,378,515 | B1 | 4/2002 | Geyer | |
| 6,405,686 | B1 | 6/2002 | Wettergard | |
| 6,470,864 | B1 | 10/2002 | Kim et al. | |
| 6,681,171 | B1 * | 1/2004 | Rimnac et al. | 701/108 |
| 6,786,210 | B1 * | 9/2004 | Kennedy et al. | 123/568.12 |
| 2003/0150434 | A1 * | 8/2003 | Leedham et al. | 123/568.12 |

* cited by examiner

*Primary Examiner*—Willis R. Wolfe, Jr.
(74) *Attorney, Agent, or Firm*—Rothwell, Figg, Ernst & Manbeck, pc

(57) ABSTRACT

In preferred embodiments, to, e.g., eliminate condensation build-up in the intake manifold and power cylinders, a charge-air cooler (CAC) and/or EGR cooler "bypass" system is provided that can, e.g., control the intake manifold temperature (IMT) above the dew-point temperature of the boosted air. Preferably, a two-port, single valve-body type valve is provided that proportionally controls the amount of charge-air that is "bypassed" (e.g., not cooled), while simultaneously diverting the charge-air cooler return, preferably, inversely proportionally.

25 Claims, 7 Drawing Sheets

COOLER BYPASS VALVE SYSTEM AND METHOD

BACKGROUND

1. Field of the Invention

The preferred embodiments of present invention relate generally to, among other things, internal combustion engines and, more particularly, to internal combustion engines employing internal exhaust gas recirculation (EGR).

2. Discussion of the Background

Many modern vehicles are turning to the implementation of exhaust gas recirculation in which, e.g., exhaust gasses are cooled and burned again to achieve lower chemical emission levels. A number of known systems and methods are illustrated, by way of example, in the patents discussed below.

U.S. Pat. No. 6,470,864, the disclosure of which is incorporated herein by reference in its entirety (e.g., for background), and which is also assigned to the present assignee, Mack Trucks, Inc., shows a Turbocharged Engine with Exhaust Gas Recirculation (EGR), including, among other things, an EGR cooler.

U.S. Pat. No. 6,378,515, the disclosure of which is incorporated herein by reference in its entirety (e.g., for background), and which is also assigned to the present assignee, Mack Trucks, Inc., shows an Exhaust Gas Recirculation Apparatus And Method including, among other things, an EGR controller.

U.S. Pat. No. 6,336,447, the disclosure of which is incorporated herein by reference in its entirety (e.g., for background), and which is also assigned to the present assignee, Mack Trucks, Inc., shows a method and apparatus for compression brake enhancement using fuel and an intercooler bypass.

U.S. Pat. No. 6,273,076, the disclosure of which is incorporated herein by reference in its entirety (e.g., for background), states that an "object of the invention is to optimize the performance of a compression ignition internal combustion engine by . . . control of the excess air/fuel ratio and/or intake air charge temperature." Col. 4, line 8+.

U.S. Pat. No. 5,385,019, the disclosure of which is incorporated herein by reference in its entirety (e.g., for background), shows compression release engine braking methods and apparatus for use with turbocharged engines having intercoolers. See also Col. 2, line 1+.

U.S. Pat. No. 4,385,496 indicates that it shows "an intake system for an internal combustion engine having a supercharger [having] a first air passage and a second air passage each for conducting air from the supercharger to the engine." See Abstract. The '496 patent further indicates that "[t]he second air passage leads the air directly from the supercharger to the engine without cooling the air." See col. 1, line 42+.

U.S. Pat. No. 3,894,392 indicates that it shows a supercharged diesel engine having "a by-pass pipe . . . arranged in parallel with [a] cooler" and that "during the period of starting and of raising the temperature of the engine, a portion at least of the air delivered by the compressor passes through the by-pass pipe." See col. 1, lines 41+.

While a variety of exhaust gas recirculation systems and methods are known, there remains a need for new and improved systems and methods.

SUMMARY OF THE PREFERRED EMBODIMENTS

The preferred embodiments of the present invention can significantly improve upon existing systems and methods. For example, the background references do not recognize the potential for certain intake manifold and/or cylinder corrosion problems and do not provide systems or methods to inhibit the same, as in some preferred embodiments of the invention.

In that regard, during engine operation, water can condense in the inlet manifold and power-cylinders of an engine when the intake air drops below the dew-point temperature (the dew point temperature can be defined, e.g., as a temperature at which a gas would reach saturation for given boost pressure and ambient humidity conditions). This is a natural, physical occurrence, even in modern engines. With the introduction of modern exhaust gas recirculation, this same water condensation has a propensity to form aqueous acids when mixed with certain exhaust chemicals (such as, for example, a fuel's sulfur content and nitrous oxide NOx). These acids can, over time, aid in the corrosion of the inlet manifold, intake valves and/or guides. In addition, these acids can also accelerate wear and/or corrosion of cylinder liners and/or piston rings. However, analyzing and quantifying the effects of acidic condensate on engine-life is complex. For example, quantifying the engine-life recovery of any new wear material would potentially require numerous different wear-material combinations, each to be tested over long durability engine and/or rig tests.

The background references neither recognize the foregoing nor teach, among other things, a charge-air cooler bypass system that can control an inlet manifold temperature (IMT) in a manner to inhibit condensation or the creation of corrosive acids, as in some preferred embodiments of the invention.

In some embodiments of the invention, a charge air cooler bypass system is provided that includes: a bypass valve that allows turbo-boosted charged air to bypass a charge-air cooler; and a bypass valve controller that controls the bypass valve to inhibit condensation buildup in an intake manifold or power cylinder by maintaining an intake manifold temperature above the dew-point temperature. Preferably, bypass valve controller maintains the intake manifold temperature substantially within a predetermined range just above the dew-point temperature.

In some embodiments of the invention, a method of controlling an inlet manifold air temperature to inhibit condensation and the creation of corrosive acids or chemicals includes: providing a bypass valve that allows turbo-boosted charged air to bypass a charge-air cooler; and operating the bypass valve to inhibit condensation buildup in an intake manifold or power cylinder by maintaining an intake manifold temperature above the dew-point temperature. Preferably, the method includes operating the bypass valve to maintain the intake manifold temperature substantially within a predetermined range just above the dew-point temperature.

In some embodiments of the invention, a charge air cooler bypass system is provided that includes: a turbocharger that compresses air before it enters a charge air cooler; a charge air cooler that reduces the temperature of the air from the turbocharger before it enters an engine intake; and a bypass system that mixes higher temperature bypassed air with air from the charge air cooler to create a mixed boost-air temperature that is just above the dew-point temperature so as to inhibit condensation and the formation of acids.

Preferably, the bypass system includes: a bypass valve that allows turbo-boosted charged air to bypass a charge-air cooler; and a bypass valve controller that inhibits condensation buildup in an intake manifold or power cylinder by maintaining an intake manifold temperature just above the dew-point temperature. In some illustrative embodiments, the intake manifold temperature is maintained within a range of about 40, or more preferably about 30, or more preferably about 20, degrees Fahrenheit above the dew-point temperature.

In some embodiments, an internal combustion engine having at least one cylinder, an intake, a charge air cooler, and an exhaust gas re-circulator, the charge air cooler providing cooled intake air for delivery into the intake, and the exhaust gas re-circulator for introducing exhaust gas into the intake is provided that includes: a charge air cooler bypass valve for diverting a first mass flow rate of intake air around the charge air cooler and into the intake manifold when the exhaust gas re-circulator is introducing exhaust gas into the intake; a charge air cooler throttle valve for reducing a flow of the cooled intake air into the intake manifold from the charge air cooler by a second mass flow rate when the exhaust gas re-circulator is introducing exhaust gas into the intake; and means for controlling the bypass and throttle valves to cause the intake air diverted around the charge air cooler and the cooled intake air from the charge air cooler to mix to create a mixed boost-air temperature that is just above the dew-point temperature.

In some embodiments, an internal combustion engine having at least one cylinder, an intake, a charge air cooler, and an exhaust gas re-circulator, the charge air cooler providing cooled intake air for delivery into the intake, and the exhaust gas re-circulator for introducing exhaust gas into the intake is provided that includes: a charge air cooler bypass valve for diverting a first mass flow rate of intake air around the charge air cooler and into the intake manifold when the exhaust gas re-circulator is introducing exhaust gas into the intake; the charge air cooler bypass valve comprising: a bypass barrel; a bypass shaft intersecting the bypass barrel; a bypass plate rotatably connected to the bypass shaft; and wherein the bypass plate is normally closed; a charge air cooler throttle valve for reducing a flow of the cooled intake air into the intake manifold from the charge air cooler by a second mass flow rate when the exhaust gas re-circulator is introducing exhaust gas into the intake; the charge air cooler throttle valve comprising: a throttle barrel; a throttle shaft intersecting the throttle barrel; a throttle plate rotatably connected to the throttle shaft; and wherein the throttle plate is normally open; and an electronic control unit having a condensation control module adapted to control the bypass valve and the throttle valve so as to create a mixed boost-air temperature with respect to the dew-point temperature to inhibit the formation of condensation and acids.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The accompanying figures are provided by way of example, without limiting the broad scope of the invention or various other embodiments, wherein.

DETAILED DESCRIPTION OF THE PREFERRED EMBODIMENTS

Figure 1:
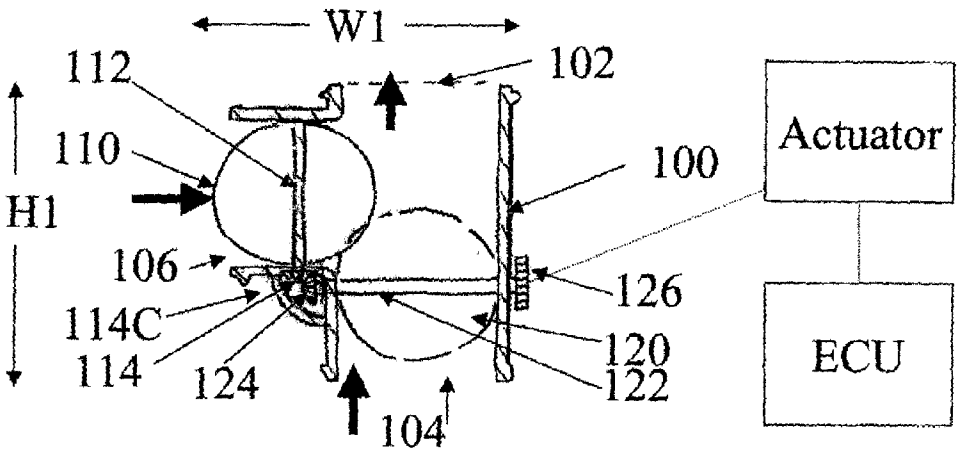
FIG. 1 is a broken-away side view of a bypass valve system according to some preferred embodiments of the invention and, in this illustrated example, having valve plates that rotate around axes that are generally perpendicular to one another.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Discussion of Various Preferred Embodiments:

In some preferred embodiments of the present invention, among other things, acid creation can be inhibited via a novel charge-air cooler (CAC) bypass system that controls the inlet manifold air temperature (IMT) to inhibit condensation and/or resultant acid creation. In some instances, the charge air cooler (CAC) can be part of an induction system that can, for example, improve engine combustion efficiency. In an illustrative system, a turbocharger can use exhaust gases to drive a compressor that compresses air before it enters the CAC. Then, the CAC can reduce the temperature of the turbo boosted air before it enters the combustion chamber. The CAC can employ any appropriate structure known in the art. In some illustrative embodiments, compressed air from the turbocharger can be cooled by ambient air flowing over cold fins that dissipate heat from hot fins in the CAC. Then, the cooled compressed air from the CAC can be directed into the intake side of the engine.

Among other things, such a system, having cooler denser air entering the engine from the CAC, can improve vehicle driveability, fuel economy and/or reduction of engine emissions.

In some preferred embodiments, to eliminate condensation build-up in the intake manifold and/or power cylinders, a CAC bypass system is provided that controls the intake manifold temperature to just above the dew-point temperature of the boosted air (e.g., to just above the dew-point temperature of the air entering the intake manifold). In preferred embodiments, this can be achieved by controlling some to all of the turbo-booster charge-air to "bypass" the charge-air cooler. In preferred embodiments, this higher temperature bypassed air can then be mixed with the CAC cooled air to create a mixed boost-air temperature that is controlled to be within a predetermined range just above the dew-point temperature (such as, e.g., within a narrow range just above the dew-point temperature).

In some preferred embodiments, one or more, and preferably all, of the following can be achieved: a) no or substantially no condensation; b) low NOx emissions (e.g., substantially the lowest possible); c) quick engine warm-up (NB: this can also aid in EPA transient cycles); and/or d) increased engine-braking power (e.g., with higher temperature "expanded" inlet air, some engine braking improvement can be realized).

In some preferred embodiments, a single valve can be provided that simultaneously controls a diverter valve element in the CAC bypass conduit and about a diverter valve element in the CAC out conduit. In some embodiments, one or both diverter valve element(s) could potentially be eliminated, as long as principles of one or more embodiment are effected with appropriate structure. For example, in some embodiments, a CAC diverter valve may be eliminated and another mechanical bypass structure can be employed.

In some instances, an EGR cooler bypass valve system may be employed. For example, in some illustrative embodiments, an EGR cooler bypass valve system can include a similar valve used for CAC bypass. In other illustrative embodiments, the same bypass valve(s) can be used for either EGR cooler bypass and/or CAC bypass.

In some preferred embodiments, a CAC bypass system can include a bypass valve having two-ports and two respective valve plates with a single valve-body that actuates both valve plates. In some preferred embodiments, the valve plates are actuated substantially inversely proportionally. In some illustrative embodiments, a CAC return port has a cross-sectional area that is a substantially full size (such as, in some illustrative and non-limiting examples, with about a 3.5 to 3.7 inch inner diameter), while the bypass port has reduced size (such as, in some illustrative and non-limiting examples, with about a 2 to 2.2 inch inner diameter) designed to flow a desired % of the total air mass flow of a highest rated engine for which it may be used (e.g., at rated horsepower). For example, in an illustrative condensation prevention mode, the % bypass may be, e.g., in a range of up to about 30–40%. As another example, in an illustrative brake mode, and/or in an illustrative warm-up mode, and/or in one or more other illustrative mode(s) for other conditions, the % bypass may be, e.g., in a range of up to about 100%.

In some preferred embodiments, an engine control unit (ECU) provides an output (which can include an electrical signal, e.g., generally similar as that for an existing exhaust gas recirculation [EGR] valve) that can be used to drive the CAC bypass control valve to "proportionally" control the amount of charge-air that is "bypassed" (e.g., not cooled), such as, e.g., within a predetermined % range, while simultaneously diverting (e.g., inhibiting flow via a created back-pressure) the charge-air cooler return. Preferably, this operation is carried out in a substantially inversely proportional manner. In some preferred embodiments, the control systems' target inlet manifold air temperature (IMT) can be controlled to remain, e.g., within a desired control range.

Figure 4:
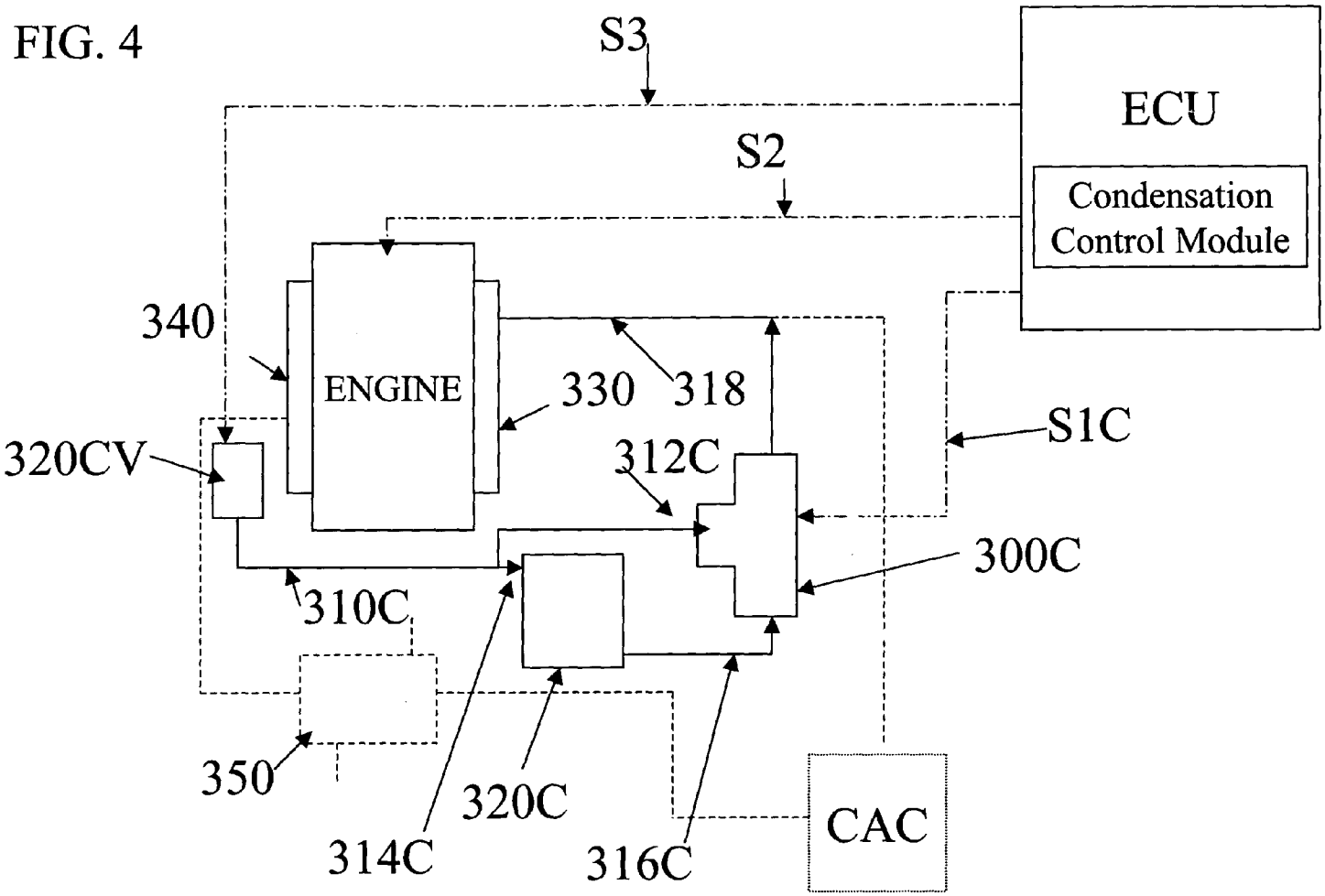
FIG. 4 is a schematic diagram depicting an EGR cooler bypass valve system within an engine system according to some illustrative embodiments of the invention.

In preferred embodiments, one CAC bypass valve is designed to fit a plurality of vehicles, such as a line of vehicles made by a particular manufacturer, such as, e.g., to fit all or substantially all MACK TRUCKS, INC.™ truck chassis designs. In FIG. 4, by way of example, a MACK TRUCK CV-chassis 450 is shown (in partial view). Among other things, the CV-chassis can have a relatively confined packaging space. In order to modify an existing structure, in some embodiments, a valve-body and an EGR-mixer can be modified in order to achieve a single valve design that would fit in numerous or all chassis configurations.

In some illustrative implementations, a CAC bypass valve system can include, e.g., specifications as follows: an IMT controlled temperature range of about ambient temperature (which may range, e.g., from about 20–130 degrees Fahrenheit (F)) to about 150 degrees F. (e.g., for maximum EGR), and in some embodiments, an IMT control range may be, e.g., between about 110 degrees F. and 140 degrees F. during, e.g., operation of a condensation prevention mode. Notably, exhaust gas temperatures before entering the CAC and/or CAC bypass valve may be, in some illustrative and non-limiting cases, within a range of up to about 450 degrees F.

In some illustrative embodiments, a CAC bypass valve system can be configured to include valve response times on the order of less than or equal to about 0.5 seconds travel between open to close and/or close to open and, more preferably, less than or equal to about 0.25 second travel time between open to close and/or close to open.

Figure 8:
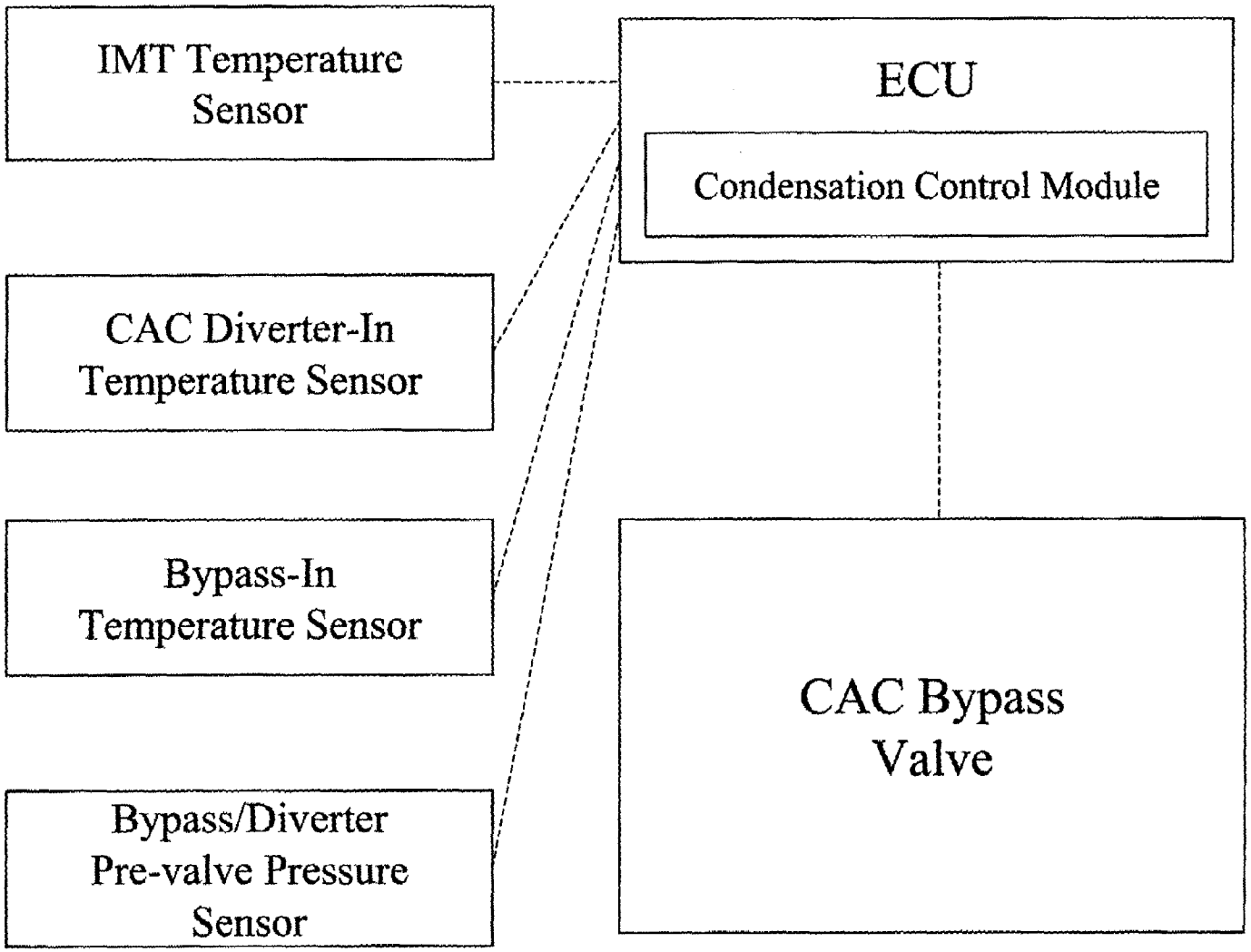
FIG. 8 is a schematic diagram showing some components for condensation control in some illustrative embodiments of the invention.

In various embodiments, the valve can be controlled in a variety of ways. In some illustrative embodiments, a proportional pneumatic control can be utilized. As shown in FIG. 8, in some embodiments, an engine control unit (ECU) can receive input from one or more sensor(s), such as, e.g., one or more temperature and/or pressure sensor, such as, e.g., an IMT temperature sensor, a CAC-in temperature sensor; a bypass-in temperature sensor; a bypass/diverter pre-valve pressure sensor; and/or the like. In addition, if desired, one or more sensor(s) could be provided to sense valve position and/or to obtain pressure feedback. In view of, among other things, Van der Waal's principle, sensors can be used, in some embodiments, to monitor temperature(s) and/or pressure(s). In embodiments utilizing an engine control unit (ECU) to control actuation of a CAC bypass valve, the ECU can transmit appropriate signals depending on the type of actuator used.

In some illustrative embodiments, the valve structure can include a variety of constructions in order to achieve various principles of the invention. In some illustrative constructions, the valve structure may include, e.g., two rotary valve elements (such as, e.g., valve elements including disks that turn on axes, such as for example on diametrical axes inside a valve body that can throttle, damper and/or restrict flow). The valve elements can include, e.g., air actuated butterfly valves. In some constructions, the valve elements can provide ON/OFF and/or proportional control. In some constructions, one valve element can be used to control bypass, while another valve element can be used to control a CAC back-pressure. In some constructions, each valve element operates substantially inversely proportional to each other.

In some embodiments, a CAC bypass system can include a valve-body, an amp-to-pressure (A:P) control valve and CAC-return and bypass plumbing. In some preferred embodiments, an A:P control valve can turn an ECU output signal into actuation air-pressure to effect movement of corresponding valve elements. In some preferred embodiments, an A:P control valve can be, e.g., mounted just above an EGR-mixer/venturi neck, such as, e.g., on a same bracket that supports the mixer's inlet end.

In some constructions, a state of CAC 100% open can be employed if a pressure signal is at or about 0. In some constructions, the pressure supply for control valve control can be within a range of, for example, between about 0–90 pounds per square inch gauge. In some embodiments, an ON/OFF control can be used for engine brake operation. For example, an ON/OFF valve could be "cycled" to control IMT, rather than having a sophisticated proportional control of the valve. For example, an ON/OFF valve could be cycled at a high frequency to control the IMT.

In some illustrative constructions, an ECU output can include any appropriate signals or the like, such as using: pulse width modulation (PWM), vehicle dynamic control (VDC) or the like. In some embodiments with proportional control, an ECU output can include a proportional current signal, such as, e.g., about 0.5–1.5 amp signals or the like in some illustrative examples. In some embodiments, the CAC bypass valve can be an electronically and/or pneumatically actuated valve (such as, e.g., an electronically and/or pneumatically actuated butterfly valve).

In some illustrative constructions, one control can be utilized. In some instances, the control can be of one 2-position/3-way valve. In some instances, the control can be of two 2-way valves (such as, e.g., wherein the valves are inversely proportional based on the same control signal).

In some illustrative constructions, a valve system can include a single valve that is a 2-port, 3-way, bypass and diverter combination valve. In some embodiments, it can be an air actuated valve. In some embodiments, it can include approximately 0 to 100% proportionally controlled bypass and diverter valves. In some preferred embodiments, it can operate inversely proportional, with a bypass valve normally closed (NC) and a CAC-diverter valve normally open (NO). As one example, two butterfly valves, operating inversely proportional to each other, can be used. In some embodiments, generally parallel and/or generally perpendicular shafts can be used as rack and pinion actuation mechanisms. In some examples, generally parallel shafts can include cantilevered straight gears. In some examples, generally perpendicular shafts can include a bevel-gear set. In some embodiments, one pneumatic cylinder can be used to actuate bypass and diverter valves, in one valve-body casting, via one amp-to-pressure (A:P) pneumatic control valve. In preferred embodiments, a single valve-system preferably simultaneously controls the bypass flow, while diverting and back-pressuring the CAC.

Preferably, the valve seals the bypass down to a low "internal leakage." Preferably, the "external leakage" is substantially less than the "internal leakage." In addition, it preferably operates at or below a noise level, in the audible frequency range, that is substantially undetectable, inside or outside a vehicle (such as, e.g., a truck), when superimposed over the engine's noise level.

In various embodiments, any appropriate material(s) can be used for the materials of the valve system, such as, e.g., metals, such as aluminum or the like for the valve casting and/or valve plates, steel or the like for gears, linkages, etc., and/or other appropriate materials.

Discussion of the Illustrated Preferred Embodiments:

A few illustrative embodiments are now described with reference to FIGS. 1–8. In this regard, FIG. 1 is a broken-away internal view of an illustrative embodiment of a CAC bypass valve 100. As shown, the bypass valve preferably includes: a discharge port 102 that leads to an inlet manifold (not shown); a CAC-out port 104; and a bypass port 106. In this manner, hot bypass air from port 106 can combine with cooled air from port 104 and be discharged via 102. The valve 100 preferably includes 2 valve plates 110 and 120. The valve plates are preferably rotatable about an axis between an open orientation (e.g., with a blocking surface generally parallel to a direction of flow) and a closed orientation (e.g., with the blocking surface generally perpendicular to a direction of flow). Preferably, the operation is substantially inversely proportional and when the valve plate 110 is in a substantially open position (such as, e.g., shown in FIG. 1), the valve plate 120 is in a substantially closed position (NB: the valve plate 120 is, however, shown in dashed lines in its open position in FIG. 1).

In the embodiment shown in FIG. 1, the valve plates 110 and 120 are rotatably supported on rotatable shafts 112 and 122, respectively. A variety of linkages can be utilized to rotate the shafts 112 and 122 and, hence, the respective plates 110 and 120. Preferably, the shafts are rotated via a common actuator and via a common control signal from an engine control unit (ECU), such as, e.g., shown in FIG. 1. In some embodiments, the shafts 110 and 120 can include meshed bevel gears 114 and 124, respectively, at ends thereof so as to rotate substantially synchronously together. In some embodiments, the bevel gears can be located within an external chamber 114C separated from the internal air flow.

In preferred embodiments, the valve plates are operated so as to open and close substantially inversely to one another. In some embodiments, an external pinion or gear 126 can be attached to one of the shafts (such as, e.g., shaft 122 as shown). Then, an actuator can be used to rotate the shafts via the pinion or gear. It should be understood that in various other embodiments, the valve plates can be opened and/or closed via a variety of other mechanisms. Additionally, while two valve plates are shown, a variety of other valve structures can be used so long as the valve structures appropriately allow and/or restrict flow according to principles of one or more of the various embodiments of the invention.

In some embodiments, the actuator can include any appropriate device, such as, e.g., a solenoid, a motor, a pressure cylinder and/or the like. In various embodiments, a pinion or gear 126 could be rotated via another mechanical element having teeth that mesh with teeth of the gear, such as, e.g., via a reciprocated rack, a rotated gear, a rotated chain, a rotated timing belt and/or another appropriate structure. In some preferred embodiments, a pressure cylinder having a reciprocated rack can be used (such as, e.g., similar to that shown in FIG. 2).

n some illustrative embodiments, the valve can be configured such that the width W1 is substantially less than about 7 inches and, more preferably, about 6 inches or less and such that the height H1 is substantially less than about 10 inches and, more preferably, about 8 inches or less.

Figure 2:
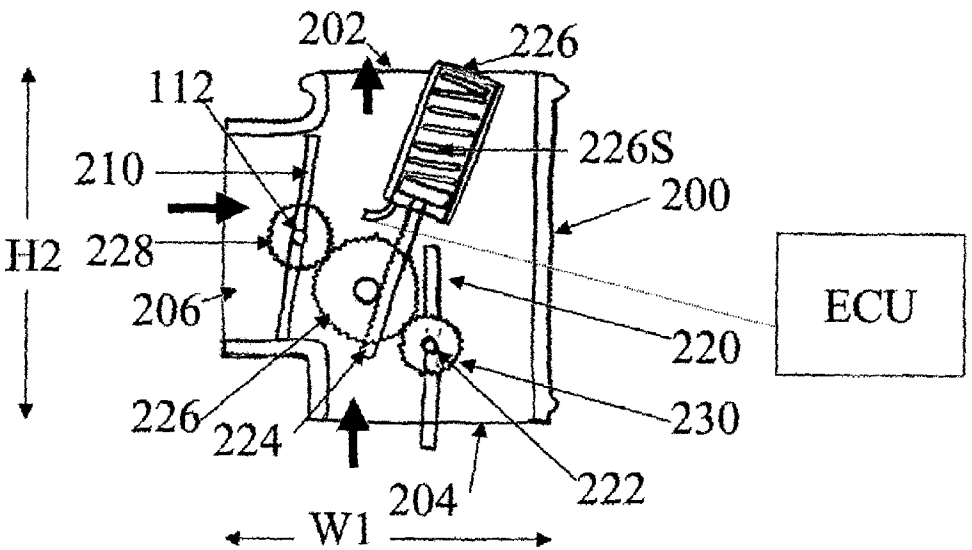
FIG. 2 is a broken-away side view of a bypass valve system according to some other preferred embodiments of the invention and having, in this illustrated example, valve plates that rotate around axes that are generally parallel to one another.

FIG. 2 is a perspective view of an illustrative embodiment of a CAC bypass valve 200. As shown, the bypass valve preferably includes: a discharge port 202 that leads to an inlet manifold (not shown); a CAC-out port 204; and a bypass port 206. In this manner, hot bypass air from port 206 can combine with cooled air from port 204 and be discharged via the port 202. The valve 200 preferably includes 2 valve plates 210 and 220. While the embodiment shown in FIG. 1 preferably includes valve plates that, e.g., rotate around axes that are generally perpendicular to one another, the embodiment shown in FIG. 2 preferably includes valve plates that rotate around axes that are substantially parallel to one another. The valve plates 210 and 220 are preferably rotatable between an open orientation (e.g., with a blocking surface generally parallel to a direction of flow such as the orientation of the plate 220 shown in FIG. 2) and a closed orientation (e.g., with the blocking surface generally perpendicular to a direction of flow such as the orientation of the plate 210 shown in FIG. 2). Preferably, the operation is substantially inversely proportional and when the valve plate 210 is in a substantially open position, the valve plate 220 is in a substantially closed position.

In the embodiment shown in FIG. 2, the valve plates 210 and 220 are rotatably supported on rotatable shafts 212 and 222, respectively. A variety of linkages can be utilized to rotate the shafts 212 and 222 and, hence, the respective plates 210 and 220. Preferably, the shafts are rotated via a common actuator and via a common control signal from an engine control unit (ECU). In some embodiments, the shafts 210 and 220 can include meshed gears 228 and 230, respectively, at ends thereof so as to rotate substantially synchronously together. In some embodiments, these gears can be located within an external chamber (not shown) separated from the internal air flow. Preferably, the valve plates are operated so as to open and close substantially inversely to one another. In some embodiments, an external drive gear 226 can be provided that has teeth that mesh with teeth on the gears 228 and 230. Then, an actuator can be used to rotate the shafts via drive gear 230.

In various other embodiments, the valve plates can be opened and/or closed via a variety of other mechanisms. Additionally, while generally circular valve plates are shown, a variety of other valve elements or structures can be used as long as such allow and/or restrict flow according to principles of one or more of the various embodiments of the invention. In some embodiments, the actuator could include any appropriate device, such as, e.g., a solenoid, a motor, a pressure cylinder and/or the like. In some embodiments, a gear 226 could be rotated via another mechanical element having teeth that mesh with teeth of the gear, such as, e.g., via a reciprocated rack, a rotated gear, a rotated chain, a rotated timing belt and/or other appropriate structure.

In some preferred embodiments, a pressure cylinder 220 having a reciprocated rack 224 can be used (such as, e.g., like that shown in FIG. 2). In some embodiments, the pressure cylinder can be packaged to the outside of the valve structure. In some preferred embodiments, the system provides a high throttle sensitivity rack and pinion gear set. In some preferred embodiments, a pressure cylinder is used that includes a return spring 226S and an a plunger that is exposed to air pressure. In preferred embodiments, the system provides a long rack travel versus a corresponding valve angle.

In some embodiments, the valve 200 can be configured such that the width W2 is substantially less than about 6 inches and, more preferably, less than about 5–5½ inches and such that the height H1 is substantially less than about 7 inches and, more preferably, less than about 6½ inches.

Figure 3:
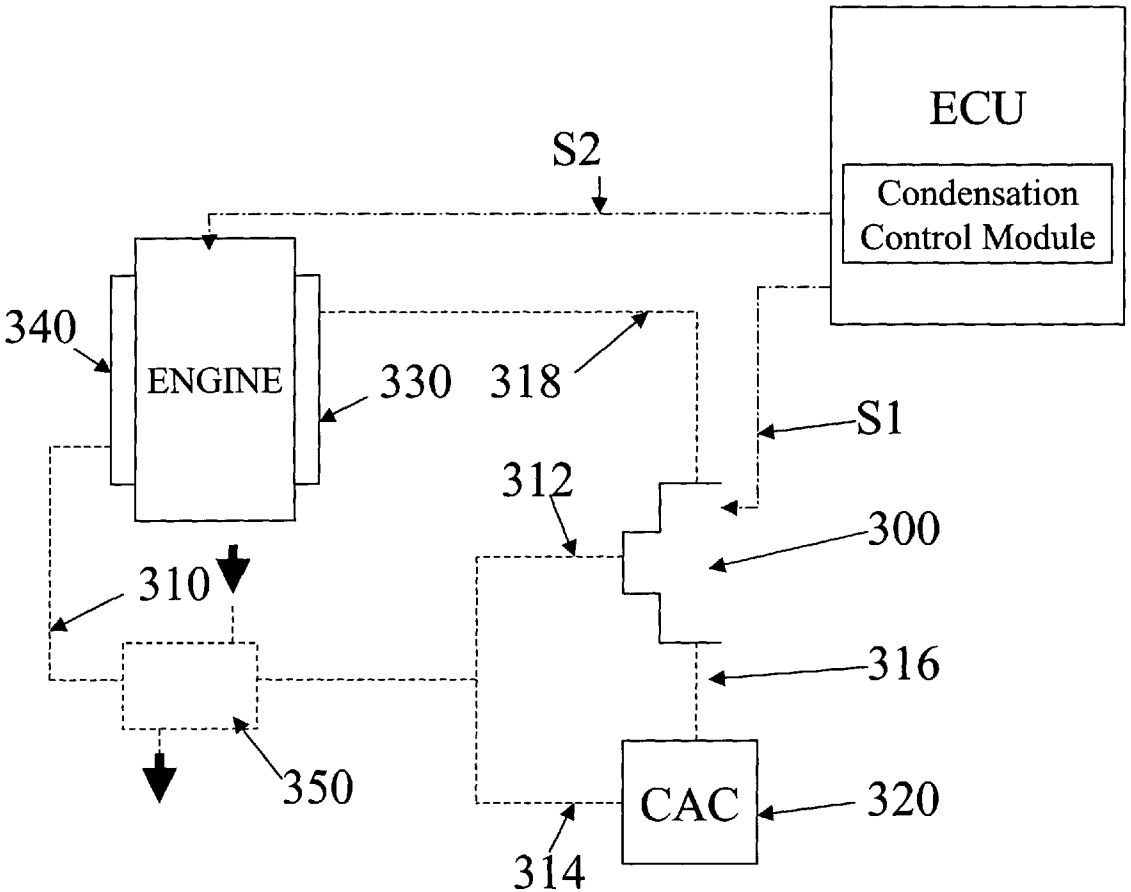
FIG. 3 is a schematic diagram depicting a CAC bypass valve system within an engine system according to some illustrative embodiments of the invention.

FIG. 3 is a schematic diagram depicting a CAC bypass valve 300, employing principles of one or more of the various embodiments discussed herein, in an illustrative engine system. As shown, the valve 300 can be situated between a CAC 320 and an engine intake manifold 330. As shown, an engine control unit (ECU) can be used to send control signals S1 to actuate the valve 300 and/or S2 for other engine operation control purposes. Exhaust gas exits through the exhaust gas manifold 340, and an exhaust gas conduit 310 can be provided so as to provide at least some exhaust gas re-circulation. The conduit 310 can lead to a bypass conduit 312 and to a CAC intake conduit 314. The dashed lines demonstrate the schematic nature of the flow and communication which may be modified in a variety of ways in various embodiments. In preferred embodiments, a turbocharger 350 is provided. The turbocharger can operate in any known manner, such as, e.g., as set forth above and/or as set forth in, for instance U.S. Pat. Nos. 6,336,447 or 5,385,019 incorporated herein by reference.

FIG. 4 is a schematic diagram depicting an illustrative EGR cooler bypass valve 300C, employing principles of one or more of the various embodiments discussed herein, in an illustrative engine system. In the embodiment shown in FIG. 4, the valve can have a similar structure to that used in FIG. 3. As shown, the valve 300C can be situated between an EGR cooler 320C and an engine intake manifold 330. As shown, an engine control unit (ECU) can be used to send control signals S1C to actuate the valve 300C, S2 for other engine operation control purposes, and/or S3 to actuate the EGR valve 320CV. Exhaust gas can exit through the exhaust gas manifold 340 to the EGR valve 320CV, through the exhaust gas conduit 310C and toward the EGR cooler. The conduit 310C can lead to a bypass conduit 312C and to an EGR cooler intake conduit 314C. The solid arrows demonstrate the schematic nature of the flow and communication which may be modified in a variety of ways in various embodiments. The EGR cooler can include any appropriate EGR cooler structure known in the art. See, e.g., U.S. Pat. No. 6,470,864, incorporated by reference above.

As should be understood from this disclosure, in some implementations, one or more embodiments disclosed herein can be combined together. As one illustrative example, a system can include features as shown in both FIGS. 3 and 4, such that, e.g., valves 300 and 300C can be employed in some illustrative applications.

Figure 5:
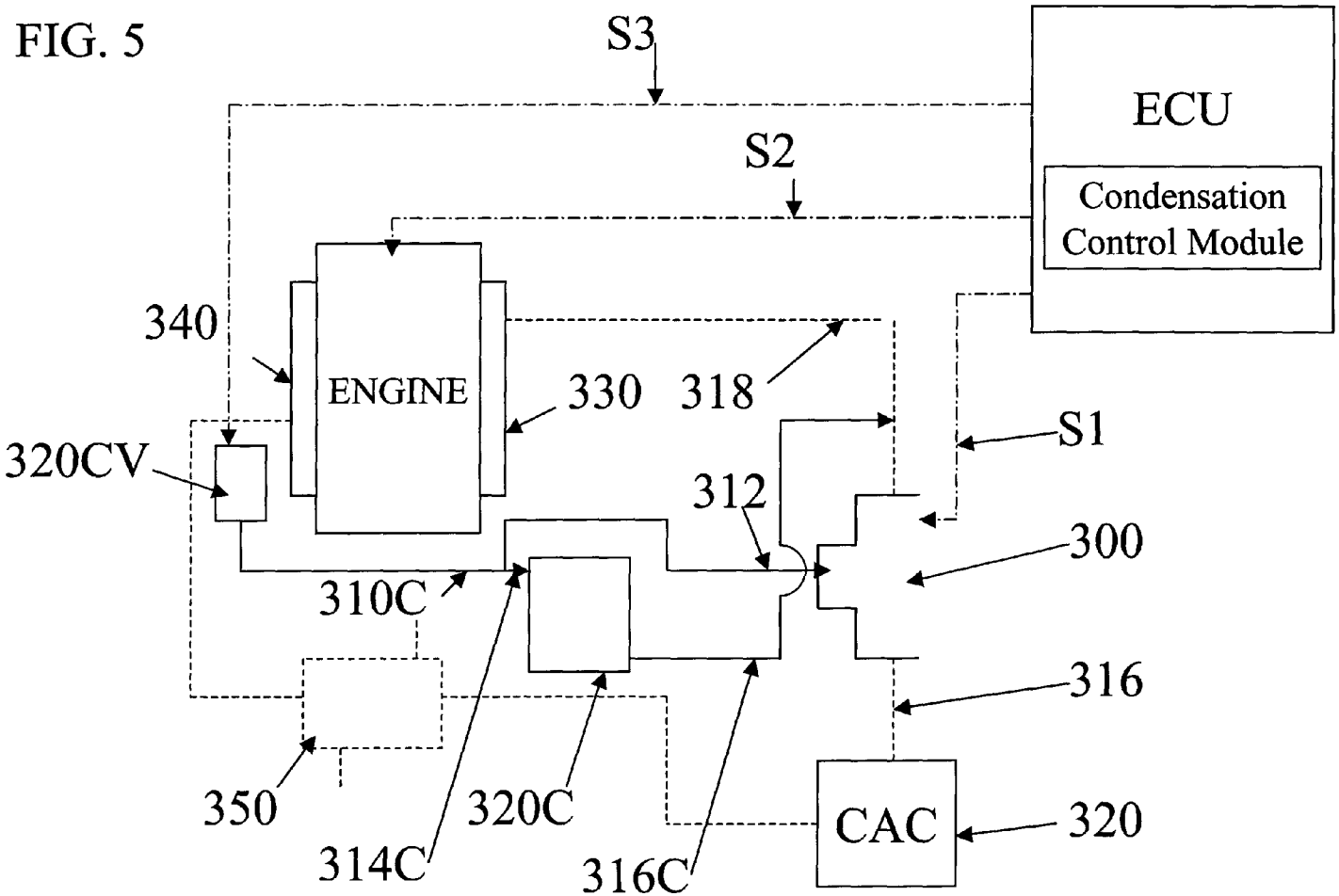
FIG. 5 is a schematic diagram depicting another EGR cooler bypass valve system within an engine system according to some illustrative embodiments of the invention.

FIG. 5 is a diagram showing an EGR cooler bypass valve system similar to that shown in FIG. 4. In FIG. 5, similar parts are shown with similar reference numbers. In the embodiment shown in FIG. 5, a similar valve can be employed. However, as shown, the valve can be arranged to bypass a parallel, or partial EGR cooler flow (e.g., operating as a partial EGR cooler bypass valve).

Figure 6:
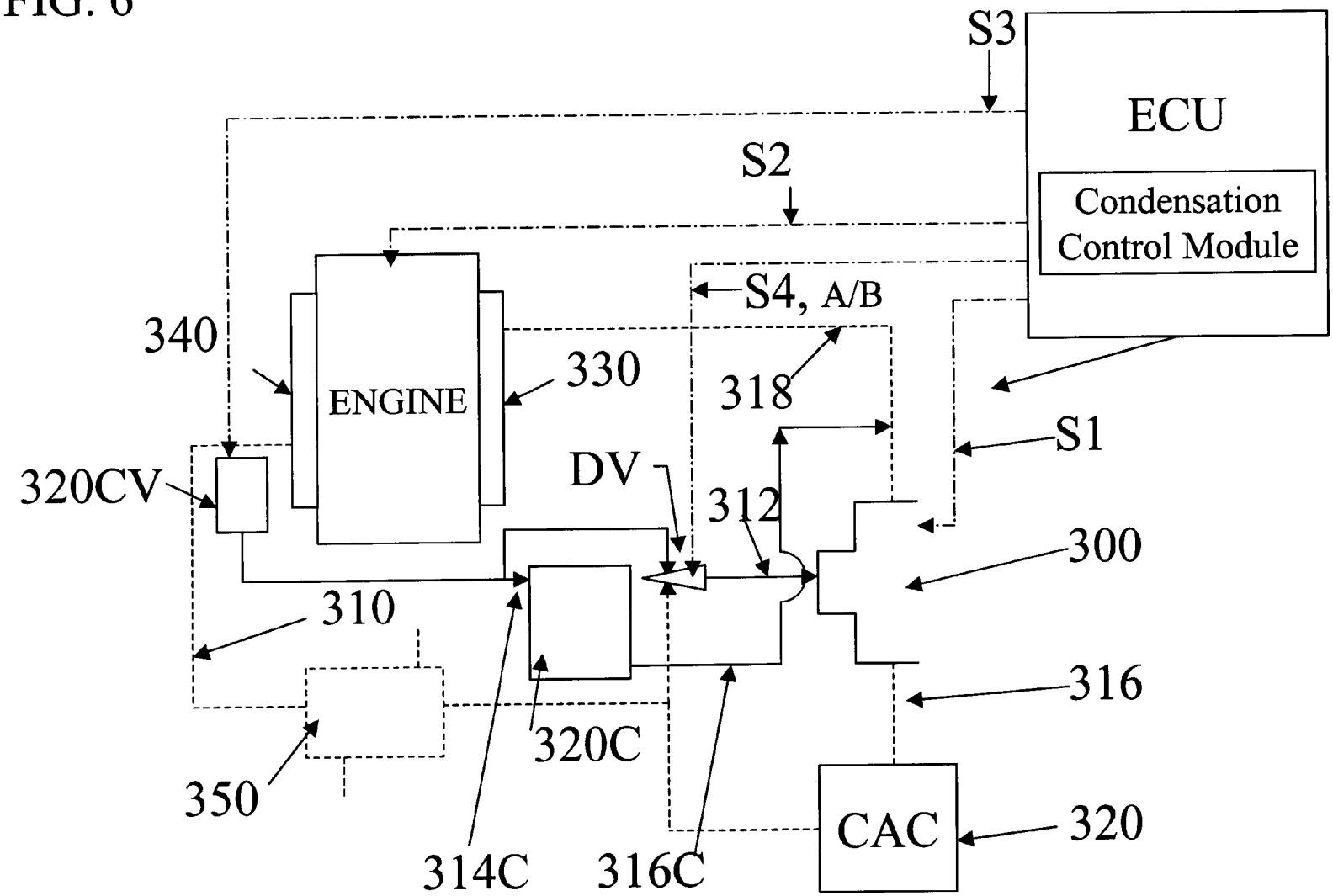
FIG. 6 is a schematic diagram depicting an EGR cooler and/or CAC cooler bypass valve system within an engine system according to some illustrative embodiments of the invention.

FIG. 6 is a diagram showing a dual EGR cooler and CAC bypass system having a diverter (e.g., a diverter valve, switch or the like) to enable one bypass valve system (e.g., including valve 300) to be used for both EGR cooler bypass and CAC bypass. In the illustrated embodiment, a simple 2-way diverter valve DV is shown (e.g., operating as an A/B switch). Preferably, the diverter valve DV can, thus, operate as either a CAC bypass valve or as an EGR cooler bypass valve-e.g., at different times. Among other things, this embodiment can have certain advantages of that shown in FIG. 5, with a less-extensive and cost-effective structure. Thus, the diverter valve DV can be used to select either CAC bypassing or EGR cooler bypassing. Preferably, the valve will be normally open (N.O.) to CAC bypassing and normally closed (N.C.) to EGR cooler bypassing. As shown in FIG. 6, the engine control unit (ECU) can be used to send control signals S4 to actuate the diverter (such as, e.g., the valve DV).

In some preferred embodiments, any of the embodiments herein can include one or more of the control elements as described in the above-referenced U.S. Pat. No. 6,378,515 (the '515 patent), which has been incorporated herein by reference in its entirety. For example, one or more of the various sensors disclosed therein can be employed, various features of the EGR controller 103 can be employed and/or the like. The features can be employed in various embodiments in order to facilitate performance of functionality described herein-above and/or to add other functionality described in the '515 patent.

Figure 7:
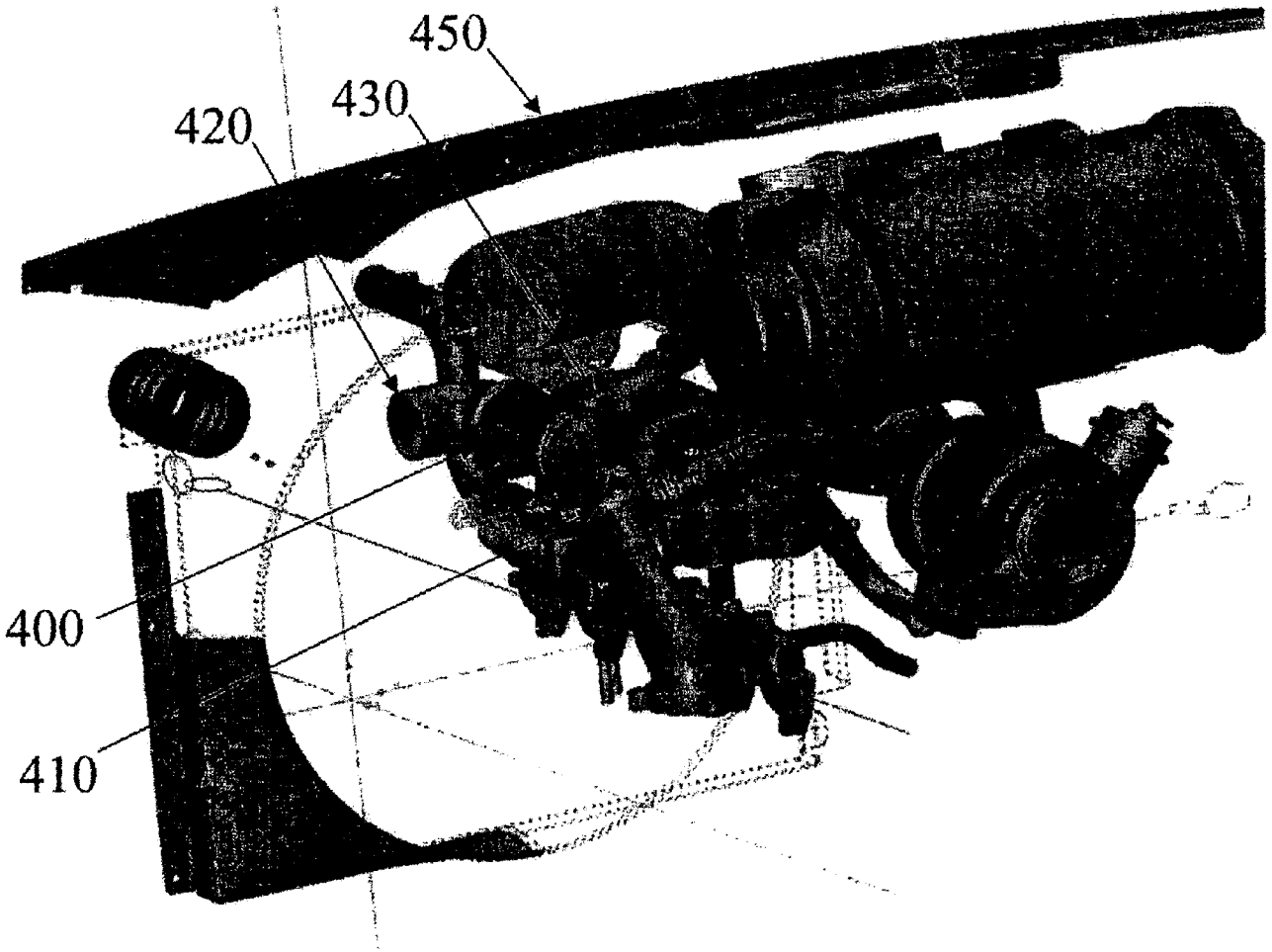
FIG. 7 is a perspective view showing an illustrative bypass valve system mounted to an illustrative exhaust gas re-circulation mixer/venture and arranged within a vehicle chassis.

FIG. 7 is a perspective view showing an illustrative CAC bypass valve 400, employing principles of one or more of the various embodiments discussed herein, mounted to an exhaust gas re-circulation mixer/venture and arranged within a vehicle chassis (shown partly at 450). In operation, CAC out gases enter the bypass valve 400 via conduit 420, bypass gas enters the bypass valve 400 via conduit 430, and gas enters the mixer/inlet manifold via conduit 410.

Discussion of Some Potential Advantages:

In some embodiments, one or more of the following and/or other advantages can be achieved.

Condensation Elimination:

In some preferred embodiments, bypassing the charge-air-cooler (CAC) can enable maintenance of the boosted intake-air at a temperature above its dew-point in a manner to prevent or inhibit condensation from occurring in the intake manifold and/or in the power-cylinders.

In preferred embodiments, a smart-control (such as, e.g,. via an electronic engine control unit [EECU] algorithm programmed and/or coded within an ECU condensation control module or the like) can be used to enable substantially complete elimination of condensation (e.g., at the lowest or substantially the lowest possible NOx creation) by, e.g., controlling the intake-air temperature to just slightly above a dew-point temperature. Notably, a higher intake temperature typically results in a higher NOx.

In preferred embodiments, the system can be advantageously used for condensation control over at least an ambient air temperature range of, for example, between about 25 degrees F. and 50 degrees F. In some preferred embodiments, the system can also be advantageously used for condensation control or the like even where ambient air temperature is less than about 25 degrees F., or, in some embodiments, less than about 20 degrees F., or, in some embodiments, less than about 15 degrees F., or, in some embodiments, less than about 10 degrees F., or, in some embodiments, less than about 5 degrees F.

In some illustrative embodiments, the "smart" control can include a system including at least some of the components shown in FIG. 5. In some embodiments, "smart" control can establish a desired valve position based upon sensed feedback of system conditions. As shown in FIG. 5, for instance, system conditions can be based on one or more sensor(s) that provide(s) temperature and/or pressure conditions. Moreover, the system can, in some instances, sense boost pressure and/or ambient humidity conditions so as to control valve positioning taking into account variation in these factors. When incorporated into the engine ECU, engine conditions (e.g., load) and/or other parameters (see, e.g., sensors, etc., discussed herein and/or parameters described in U.S. Pat. No. 6,378,515 incorporated herein) can be used to regulate bypass operation during ambient conditions. This can allow for up to 100% bypass flow (e.g., depending on circumstances) and the operation of the EGR system at colder temperatures.

In some illustrative embodiments, the control can include a system that maintains the IMT temperature within a predetermined temperature range. In some illustrative embodiments, the control can establish precision sensing of IMT temperature and can render precise dew-point temperature calculations based on sensor output, and can control the bypass valve to adjust temperature to just above the calculated dew-point temperature target. In some embodiments, the IMT temperature can be controlled to substantially remain within a range of less than about 40 degrees F. over the dew-point temperature, or within a range of less than about 30 degrees F. over the dew-point temperature, or within a range of less than about 20 degrees F. over the dew-point temperature, or within a range of less than about 10 degrees F. over the dew-point temperature, or within a range of less than about 5 degrees F. over the dew-point temperature.

Engine Warm-Up/Idle Heat Retention:

In some preferred embodiments, bypassing the CAC (e.g., at a cold start of an engine) can also and/or alternatively aid in faster engine "warm-up." For example, the sooner the engine is "warm," the lower the "white-smoke" (e.g., unburned hydrocarbons) emissions and/or the sooner the start of injection (SOI) can be retarded (e.g., for lower NOx) without white-smoke.

In addition, in some preferred embodiments, bypassing the CAC during extended idling periods (and/or in light loaded conditions—such as, e.g., city transients) can have a similar benefit as in the preceding paragraph. This can be similar to the control of coolant temperature (such as, e.g., performed by a coolant "thermostat"), but, preferably, with condensation and emissions "mapping" (e.g., rather than just having a single target temperature). In some examples, using sensed and calculated engine conditions during warm-up, can allow for up to 100% bypass operation for fastest warm-up. A control algorithm can be used to protect the bypass valve and charge air cooler by reducing bypass amounts at higher engine loads. Preferably, when the conditions are cold, a 100% bypass can be used, where possible, but an engine control can be used to back off this % bypass under heavier load conditions (e.g., to protect hardware).

Valve Design Optimization:

In some preferred embodiments, two valves (such as, e.g., butterfly-type valves and/or any other appropriate valves known in the art) with one valve-body are controlled by one proportional controller and/or actuator. As discussed above, the control is preferably in an inversely proportional manner. For example, in some embodiments, a valve-body design incorporates two valve plates or the like that are moved together, such as via close-geared together butterfly shafts, so as to utilize minimal packaging space, while enabling control of the two valve plates with one controller and/or actuator.

In some preferred embodiments, two valves can be combined in a very compact single valve-body. In some preferred embodiments, the valve-body displaces a significantly small packaging space. In some preferred embodiments, such a valve design combined with the use of rotationally adjustable V-band fitting connections enables the valve design to be integrated into numerous chassis models, such as, for instance, enabling incorporation into a line of vehicles of one or more manufacturer. For example, round (e.g., "rotatable"), ½-marmon and/or V-band port connections, along with simple elbows and/or the like can be used to enable a multitude of different chassis applications to be implemented with the same "valve" structure.

Broad Scope of the Invention:

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited.

What is claimed is:

1. A charge air cooler bypass system, comprising:

a turbocharger that compresses air before it enters a charge air cooler;

a charge air cooler that reduces the temperature of the air from the turbocharger before it enters an engine intake; and a bypass system that mixes higher temperature bypassed air with air from the charge air cooler to create a mixed boost-air temperature that is just above the dew-point temperature so as to inhibit condensation and the formation of acids;

wherein the bypass system includes:

a bypass valve that allows turbo-boosted charged air to bypass a charge-air cooler; and a bypass valve controller that inhibits condensation buildup in an intake manifold or power cylinder by maintaining an intake manifold temperature just above the dew-point temperature; and wherein said bypass valve has two-ports and two respective valve plates that are configured to be actuated substantially inversely proportionally.

2. The system of claim 1, wherein the bypass valve controller causes a single actuator to actuate both valve plates.

3. An internal combustion engine having at least one cylinder, an intake, a charge air cooler, and an exhaust gas re-circulator, said charge air cooler providing cooled intake air for delivery into said intake, and said exhaust gas re-circulator for introducing exhaust gas into said intake, comprising:

a charge air cooler bypass valve for diverting a first mass flow rate of intake air around the charge air cooler and into the intake manifold when said exhaust gas re-circulator is introducing exhaust gas into said intake;

a charge air cooler throttle valve for reducing a flow of said cooled intake air into the intake manifold from the charge air cooler by a second mass flow rate when said exhaust gas re-circulator is introducing exhaust gas into said intake; and means for controlling said bypass and throttle valves to cause said intake air diverted around said charge air cooler and said cooled intake air from the charge air cooler to mix to create a mixed boost-air temperature that is just above the dew-point temperature.

4. The internal combustion engine according to claim 3, further comprising:

a valve body;

and wherein said charge air cooler bypass valve and said charge air cooler throttle valve are installed in said valve body.

5. The internal combustion engine according to claim 4, wherein said charge air cooler bypass valve comprises:

a bypass barrel;

a bypass shaft intersecting said barrel;

a bypass plate rotatably connected to said bypass shaft;

wherein said bypass valve is normally closed.

6. The internal combustion engine according to claim 4, wherein said charge air cooler throttle valve comprises:

a throttle barrel;

a throttle shaft intersecting said barrel;

a throttle plate rotatably connected to said throttle shaft;

wherein said throttle valve is normally open.

7. An internal combustion engine having at least one cylinder, an intake, a charge air cooler, and an exhaust gas re-circulator, said charge air cooler providing cooled intake air for delivery into said intake, and said exhaust gas re-circulator for introducing exhaust gas into said intake, comprising:

a charge air cooler bypass valve for diverting a first mass flow rate of intake air around the charge air cooler and into the intake manifold when said exhaust gas re-circulator is introducing exhaust gas into said intake;

said charge air cooler bypass valve comprising:

a bypass barrel;

a bypass shaft intersecting said bypass barrel;

a bypass plate rotatably connected to said bypass shaft; and wherein said bypass plate is normally closed;

a charge air cooler throttle valve for reducing a flow of said cooled intake air into the intake manifold from the charge air cooler by a second mass flow rate when said exhaust gas re-circulator is introducing exhaust gas into said intake;

said charge air cooler throttle valve comprising:

a throttle barrel;

a throttle shaft intersecting said throttle barrel;

a throttle plate rotatably connected to said throttle shaft; and wherein said throttle plate is normally open; and an electronic control unit having a condensation control module adapted to control said bypass valve and said throttle valve so as to create a mixed boost-air temperature with respect to the dew-point temperature to inhibit the formation of condensation and acids.

8. The engine according to claim 7, wherein said first mass flow rate is substantially equal to said second mass flow rate.

9. The internal combustion engine according to claim 8, wherein said bypass shaft is substantially perpendicular to said throttle shaft.

10. The engine according to claim 8, wherein said bypass shaft is parallel to said throttle shaft.

11. The internal combustion engine according to claim 10, further comprising:

a rack;

a bypass pinion gear on said bypass shaft;

a throttle pinion gear on said throttle shaft;

wherein said bypass pinion gear and said throttle pinion gear mesh with said rack.

12. The internal combustion engine according to claim 11, further comprising:

a bypass bevel gear on said bypass shaft; and a throttle bevel gear on said throttle shaft that meshes with said bypass bevel gear.

13. A charge air cooler bypass system, comprising:

a turbocharger that compresses air before it enters a charge air cooler;

a charge air cooler that reduces the temperature of the air from the turbocharger before it enters an engine intake; and a bypass system that mixes higher temperature bypassed air with air from the charge air cooler to create a mixed boost-air temperature that is just above the dew-point temperature so as to inhibit condensation and the formation of acids;

wherein the bypass system includes:

a bypass valve that allows turbo-boosted charged air to bypass a charge-air cooler; and a bypass valve controller that inhibits condensation buildup in an intake manifold or power cylinder by maintaining an intake manifold temperature just above the dew-point temperature;

wherein the bypass valve includes two valves in a single valve body.

14. The system of claim 13, wherein the intake manifold temperature is maintained within a range of about 40 degrees Fahrenheit above the dew-point temperature.

15. The system of claim 13, wherein the intake manifold temperature is maintained within a range of about 30 degrees Fahrenheit above the dew-point temperature.

16. The system of claim 13, wherein the intake manifold temperature is maintained within a range of about 20 degrees Fahrenheit above the dew-point temperature.

17. The system of claim 13, wherein said controller is configured to control said bypass valve to cause substantially no condensation to be present in said intake manifold during operation.

18. The system of claim 13, wherein said controller is configured to control said bypass valve to achieve substantially the lowest possible NOx emissions by allowing the use of EGR at low ambient temperatures.

19. The system of claim 13, wherein said controller is adapted to activate said bypass valve so as to quicken engine warm-up.

20. The system of claim 13, wherein said controller is adapted to activate said bypass valve so as to increase engine-braking power by introducing higher temperature expanded air during braking.

21. The system of claim 13, wherein said controller includes an engine control unit that provides an output that drives the bypass valve to proportionally control the amount of charge-air that is bypassed within a range of about 0–100% while simultaneously diverting charge-air cooler return.

22. The system of claim 13, wherein said controller is configured to control said bypass valve to run exhaust gas recirculation even at low ambient temperatures.

23. The system of claim 22, wherein said controller is configured to control said bypass valve to run exhaust gas recirculation even at ambient temperatures of below 25 degrees F.

24. The system of claim 22, wherein said controller is configured to control said bypass valve to run exhaust gas recirculation even at ambient temperatures of below 15 degrees F.

25. The system of claim 22, wherein said controller is configured to control said bypass valve to run exhaust gas recirculation even at ambient temperatures of below 5 degrees F.

* * * * *